US009134087B2

(12) United States Patent
Canham

(10) Patent No.: US 9,134,087 B2
(45) Date of Patent: Sep. 15, 2015

(54) GUN BORE CLEANING DEVICE

(71) Applicant: Charles V. Canham, Portland, OR (US)

(72) Inventor: Charles V. Canham, Portland, OR (US)

( * ) Notice: Subject to any disclaimer, the term of this patent is extended or adjusted under 35 U.S.C. 154(b) by 89 days.

(21) Appl. No.: 13/834,538

(22) Filed: Mar. 15, 2013

(65) Prior Publication Data

US 2014/0082989 A1 Mar. 27, 2014

Related U.S. Application Data

(60) Provisional application No. 61/705,065, filed on Sep. 24, 2012.

(51) Int. Cl.
*F41A 31/00* (2006.01)
*F41A 29/02* (2006.01)

(52) U.S. Cl.
CPC ..... *F41A 29/02* (2013.01)

(58) Field of Classification Search
CPC ..... F41A 29/02; F41A 29/00; B08B 9/0436; B08B 9/00; B08B 1/00; B08B 9/055; A46B 3/18; A46B 2200/3013
USPC ..... 42/95
See application file for complete search history.

(56) References Cited

U.S. PATENT DOCUMENTS

| | | | | |
|---|---|---|---|---|
| 46,441 | A | 2/1865 | Berchmeyer | |
| 232,118 | A * | 9/1880 | Felthousen | 15/104.066 |
| 821,198 | A * | 5/1906 | Stocker | 15/104.165 |
| 1,195,308 | A * | 8/1916 | Whidden | 15/104.2 |
| 1,415,950 | A * | 5/1922 | Poole | 15/104.15 |
| 1,863,950 | A * | 6/1932 | Stubbs | 15/179 |
| 1,882,576 | A * | 10/1932 | Hannaford | 15/104.9 |
| 1,920,283 | A * | 8/1933 | Vroom | 15/104.2 |
| 1,996,544 | A * | 4/1935 | Justice | 15/183 |
| 2,642,602 | A * | 6/1953 | Kelly | 15/104.16 |
| 2,728,929 | A * | 1/1956 | Bell | 15/104.011 |
| 2,755,496 | A * | 7/1956 | Benyak | 15/180 |
| 2,805,434 | A * | 9/1957 | Hopkins | 15/104.16 |
| 3,205,518 | A * | 9/1965 | Romaine | 15/104.165 |
| 3,466,691 | A * | 9/1969 | Wessel | 15/104.19 |
| 4,310,942 | A * | 1/1982 | Krape | 15/104.066 |
| 4,503,578 | A * | 3/1985 | McIntyre | 15/104.165 |
| 4,546,519 | A | 10/1985 | Pembroke | |
| 5,588,242 | A | 12/1996 | Hughes | |

(Continued)

FOREIGN PATENT DOCUMENTS

| | | |
|---|---|---|
| JP | 56-076540 | 6/1981 |
| WO | 2009085013 A1 | 7/2009 |

OTHER PUBLICATIONS

Richard G. Hasenbein, Wear and Erosion in Large Caliber Gun Barrels (15 pages), paper presented at RTO AVT Specialists' Meeting, Jun. 7-9, 2003, Weapon Systems & Technology Directorate, Watervliet, NY.

(Continued)

*Primary Examiner* — Samir Abdosh
(74) *Attorney, Agent, or Firm* — Chernoff, Vilhauer, McClung & Stenzel, LLP

(57) ABSTRACT

A device for cleaning a bore of a firearm. One or more bore-cleaning bodies may include a core and a fabric cover, and a central member used to compress the core longitudinally and expand it radially to apply radial force pressing the fabric cover against the interior bore surface. A small-bore version may include flexible portions to be able to negotiate a breech mechanism of a repeating small arm.

16 Claims, 9 Drawing Sheets

(56) References Cited

U.S. PATENT DOCUMENTS

| | | | | |
|---|---|---|---|---|
| 5,871,589 | A * | 2/1999 | Hedge | 134/8 |
| 5,972,125 | A | 10/1999 | Hedge | |
| 6,088,866 | A | 7/2000 | Hedge | |
| 2006/0260079 | A1 * | 11/2006 | Horton | 15/165 |
| 2007/0151055 | A1 * | 7/2007 | Chee et al. | 15/104.061 |
| 2009/0065028 | A1 | 3/2009 | Pulliainen | |
| 2011/0119845 | A1 | 5/2011 | Kim | |
| 2014/0123417 | A1 * | 5/2014 | Chee et al. | 15/104.061 |

OTHER PUBLICATIONS

Joint Stock Company, Central Research Institute, 1139 Barrel-bore Cleaning Machine (2 pages), web pages downloaded from http://www.burevestnik.com/products_engl/1i39.html, Sep. 15, 2012, Nizhny Novgorod, Russia.

MKU, Universal Gun Barrel Cleaning System, web page downloaded from http://www.mku.com/gun-barrel.asp on Sep. 15, 2012, Uttar Pradesh, India.

Airnesco, Bore Cleaning System (3 pages), web pages downloaded from http://www.airnesco.com/bore-cleaning.html on Sep. 14, 2012, Kent, United Kingdom.

Polartherm Oy, Gun barrel cleaning equipment, web page downloaded from http://www.polrtherm.fi/en/en_products/military-heaters/artillery-suport.html on Sep. 14, 2012, Luvia, Finland.

Milfoam International Limited, Milfoam—the Complete Gun Barrel Cleaning System (2 pages), web pages downloaded from http://www.army-technology.com/contractors/artillery/milfoam/ on Sep. 14, 2012, Middlesex, United Kingdom.

Milfoam Ltd., Barrel Cleaning Solution Barrel Cleaning Products (2 pages), web pages downloaded from http://www.milfoam.fi/barrel_cleaning_products.html. Suomi, Finland.

Campbell Machinery Ltd., Vapormatt Applications, web pages downloaded from http://www.campbellmachinery.ie/pages/vapormatt_applications.htm (9 pages), at least as early as Sep. 1, 2012, p. 6, Bray, Co. Wicklow, Ireland.

Unattributed elaboration of the Vapormatt wet slurry pumping system for gun barrel cleaning, at least as early as Sep. 14, 2012.

* cited by examiner

GUN BORE CLEANING DEVICE

BACKGROUND OF THE INVENTION

The present invention is related to firearms, and particularly to apparatus for cleaning a bore of a firearm, either a cannon with a bore diameter of as much as 205 millimeters or a firearm with a smaller bore, including a shotgun or a rifle with a bore as small as .22 caliber.

Discharging firearms results in residue from the combustion of propellant and residue from wadding and the parts of a projectile that come into frictional contact with the interior surfaces of a gun tube. Cleaning a gun bore is periodically necessary to permit inspection, so that small cracks might be discovered before they can become dangerously enlarged. Cleaning is also necessary to avoid corrosion resulting from chemical products of combustion of a propellant, and to remove particulate matter left behind from friction of a projectile within the gun tube, particularly since some projectiles may leave behind particles of materials which might be dangerous or carcinogenic to personnel.

Currently the military is using a device similar in shape to a plumber's plunger to clean bores of guns. The same device in different sizes is used for several gun calibers, but this device does a poor job of cleaning the barrels of artillery guns. It requires many passes and up to six hours to clean a cannon barrel using this device.

In current cleaning methodologies, the cleaning process starts by inserting the cleaning device into the muzzle of the barrel and forcing the dislodged material towards the breech of the barrel. This in turn dictates that the residue must be blown out of the bore to complete the cleaning operation and in some cases such as cleaning a tank gun bore, residue thus can become airborne in a quite confined space. The residue then must be removed from that confined space, subjecting the armorer/technician to materials such as lead, carbon and in some cases depleted uranium particulates. Many such substances included in gun bore residues are known to have adverse affects on the human body.

SUMMARY OF THE INVENTION

The present invention provides a device which can economically and efficiently apply a solvent or lubricant or both to the interior surfaces of a gun bore and then scrub away propellant residue, projectile residue, and other materials fouling the surfaces of the gun bore, and a method of cleaning a gun bore so that the gun bore is clean enough for effective inspection and is free from corrosive chemical deposits, and so that potentially dangerous material is removed from the gun tube, including the chamber, so as to avoid exposing personnel to potentially dangerous particulates or chemical residue.

As defined in part by the claims that are a part of this disclosure, a bore-cleaning device according to the present invention includes at least one elongate bore-cleaning body including a generally cylindrical core having opposite ends, a pair of end plates each adjacent to one of the opposite ends of the core, an internal tensioning member to pull the ends plates toward each other to compress the bore-cleaning body longitudinally and thus expand it radially to support the fabric cover in contact with the interior of a bore being cleaned, and a connector at an end of the bore-cleaning body that can receive a tension-bearing member to pull the bore-cleaning device through a bore.

In one embodiment there are two separate bore-cleaning bodies, each having a fabric cover, the bore-cleaning bodies being interconnected with each other to be pulled in tandem through a bore being cleaned.

In another embodiment a mechanical scrubbing section such as a wire brush may be provided between two separate bore-cleaning bodies with fabric covers.

In another embodiment separate bore-cleaning bodies and a scrubbing section may be interconnected with each other by flexible connectors.

In one embodiment of the device an internal tensioning member within a cleaning body may be of a flexible construction to permit the bore-cleaning device to bend during insertion into a breech of a firearm such as a repeating rifle.

The bore cleaning system described herein significantly reduces the time that the armorer/technician needs to spend conducting the cleaning of gun bores ranging from as large as a 205 millimeter cannon barrel down to shotguns or .22 caliber rifles. This system is very adaptable to many barrel sizes and is adaptable for cleaning gun barrels such as tanks, mortars, shotguns, hunting rifles, long guns, and others. The system is adaptable to many types and sizes of gun barrel. The system works with multiple material types such as hard chromed, electroplated and steel surfaces of the interior of a barrel without degrading the bluing or dimensional stability of the substrate of the barrel. The system is not limited as to bore surfaces and substrate types by the unavailability of proprietary and commercially available cleaning and scrubbing agents. The system also works on multiple geometric configurations within different barrel types. The system according to this invention may include a carrying case, bore cleaner, replacement bore scrubber material, pull handle, and attachment cable.

The bore cleaning system disclosed herein may significantly reduce the amount of dangerous or bothersome particles that tend to be dislodged and become airborne in restricted spaces surrounding the breech of a gun during the bore cleaning process, by beginning the process of cleaning at the breech end of the barrel.

The foregoing and other objectives and features of the invention will be more readily understood upon consideration of the following detailed description of the invention, taken in conjunction with the accompanying drawings.

DETAILED DESCRIPTION OF PREFERRED EMBODIMENT

Figure 1:
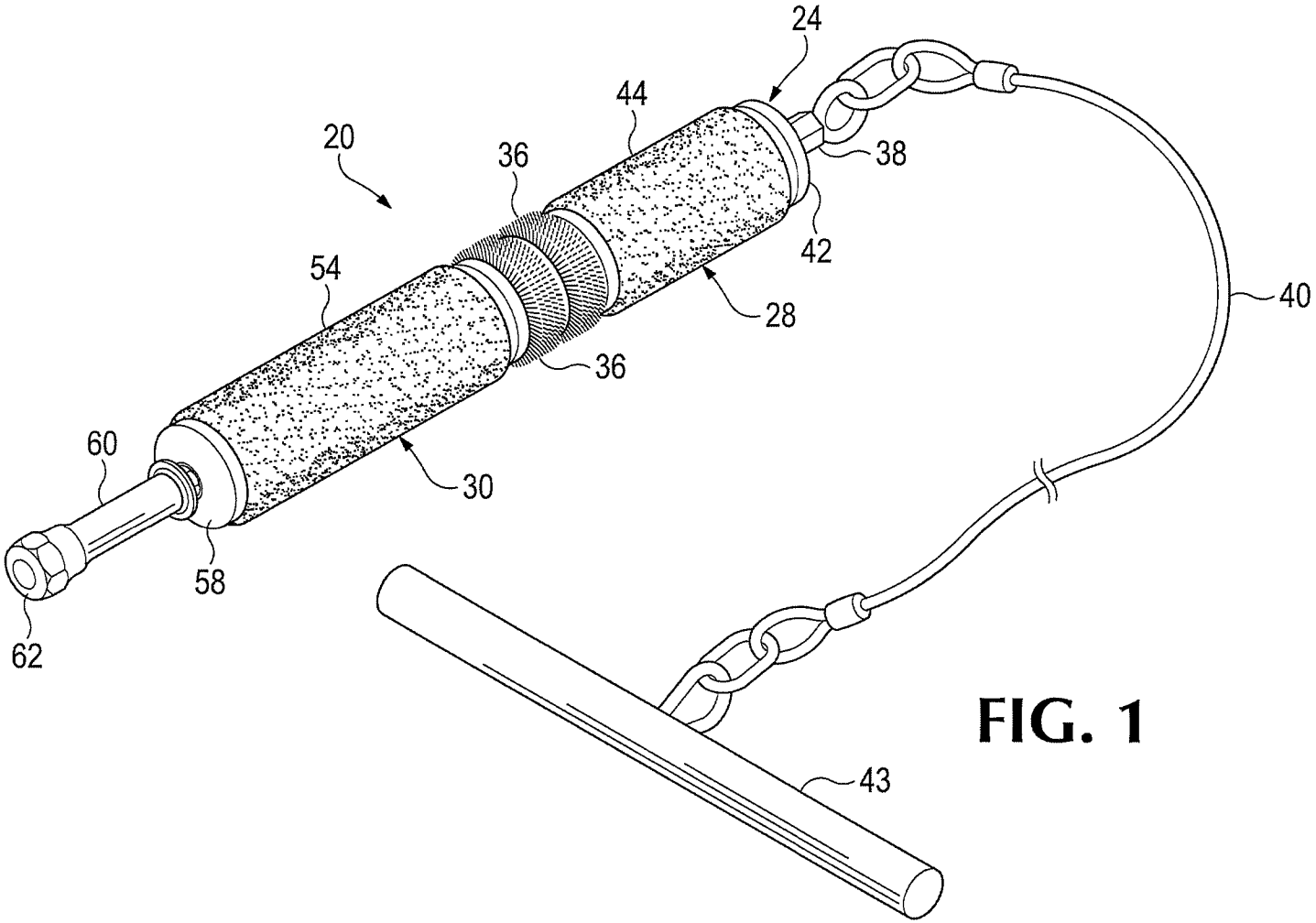
FIG. 1 is a perspective view of a bore-cleaning device according to one embodiment of the present invention.
Figure 2:
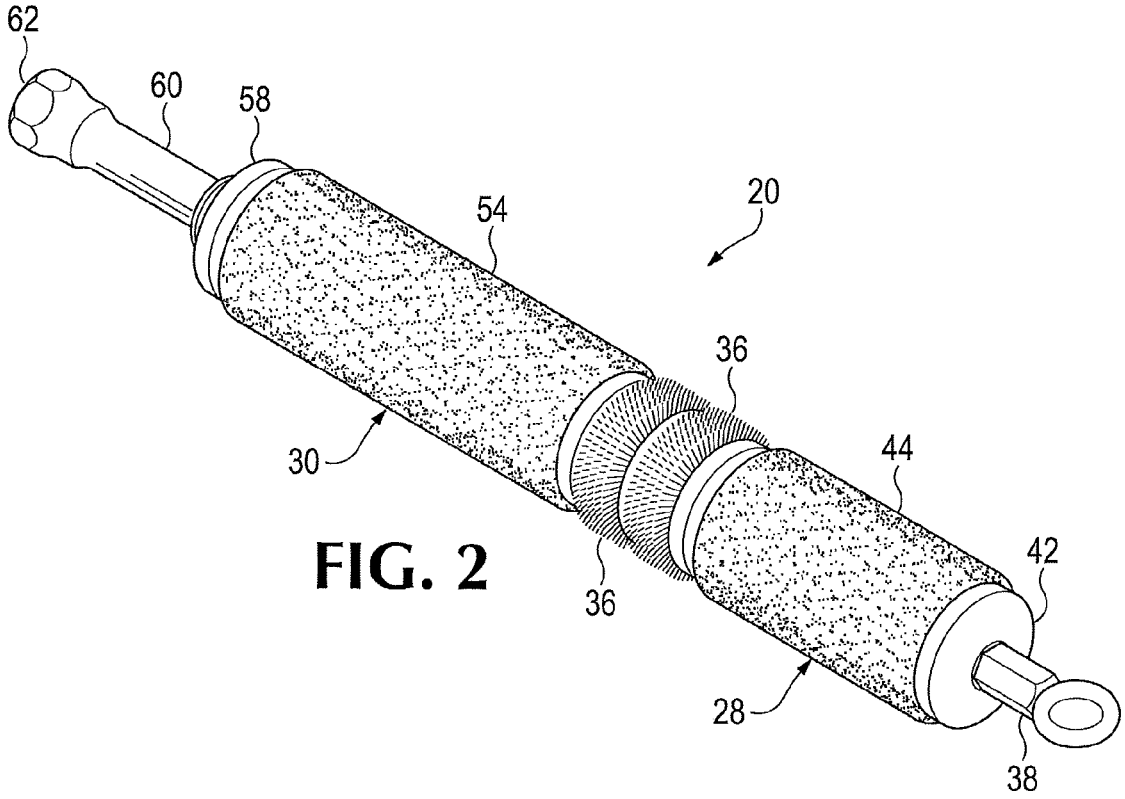
FIG. 2 is an isometric view of the bore-cleaning body of the device shown in FIG. 1, taken from a muzzle end of the bore-cleaning device.

Referring first to FIGS. 1, 2, 3A, 3B, 4, 5A, 5B and 5C of the drawings, an exemplary bore-cleaning device 20 according to this disclosure is made up of several parts. As an example, a bore-cleaning device 20 for a 105 millimeter tank gun barrel may include a threaded steel rod 22, which, for example, may be of ⅝-inch diameter and three feet long, used as a center shaft which holds the cleaning device 20 together. The rod 22, or internal tensioning member, allows the bore cleaner 20 to be tightened at its outer ends 24 and 26, which compresses each bore-cleaning body section 28 and 30 longitudinally and thereby creates radial expansion of the cores 32 and 34 of the sections, giving the operator control over proper fit to the barrel size for maximum cleaning in both the chamber and the somewhat smaller rifled portion of the bore. The rod 22 also transmits the pulling forces to each end portion 28 and 30 and brushes 36 in the middle, so the bore-cleaning device 20 moves smoothly through the bore.

A top cap 38 at the leading, or muzzle end of the bore-cleaning device 20 may include a rigid member with a threaded portion, and a carabiner or eye to facilitate connection of a flexible tension-bearing member 40 to the rod 22 to provide the user a convenient way to pull the device 20 through a bore to be cleaned. The top cap 38 uses the threaded rod 22 to tighten down on an end member or plate 42 to provide longitudinal pressure on the core 32.

The tension-bearing member 40 may be constructed with a core such as Nylon rope, stainless steel wire cable, or other materials having adequate tensile strength. It may advantageously be encased in a protective coating such as a thin layer of polyurethane to protect the inside of the bore being cleaned from inadvertent contact. The tension-bearing member 40 may be used in an appropriate length to act as a connecting device between a handle member 43 and the cleaning head and to vary the length of pull to a particular gun barrel length.

A cleaning device 20 may include several sections providing different functions depending on the application to the bore being cleaned.

The end plate 42 may have the shape of a disc including a central hole receiving the threaded rod 22 and may resemble a large rubber washer between the top cap 38 and a fabric cover 44, or sock, on the core 32. The end plate 42 presses on the inwardly turned and gathered fabric end portion of the cover 44 to hold the fabric cover 44 in place on the core 32 through the cleaning process.

The core 32 of the leading first, or oiling, cleaning body 28 has a generally cylindrical shape, and may have a dense foam rubber center covered with a ½-inch layer of softer foam rubber which allows for longitudinal compression and consequent radial expansion of the core 32 as tension is increased in the rod 22. Alternatively, the core 32 may be an extruded body of a resilient polyurethane or a thermo-plastic rubber material. The cover 44 of the core 32 may be of a coarse, or rough, fabric, presenting an outer wiping surface. The cover 44 may be a tubular knitted sock or woven fabric sewn to a tubular shape. This leading cleaning body 28 section of the bore cleaner 20 can be used to carry a quantity of oil or a mixture of oil and a suitable solvent to help remove gunpowder residue and other residue from the gun bore surfaces. The rough fabric cover 44 is equivalent to many conventional cleaning patches, so this front or oiling cleaning body section 28 has the same effect as running many oiled patches through the bore at one time. This fabric sock or cover 44 can be quickly changed by loosening the end cap 38 along the central rod 22 so the fabric cover 44 can be reversed to expose a clean side or be replaced with a new one.

Figure 9:
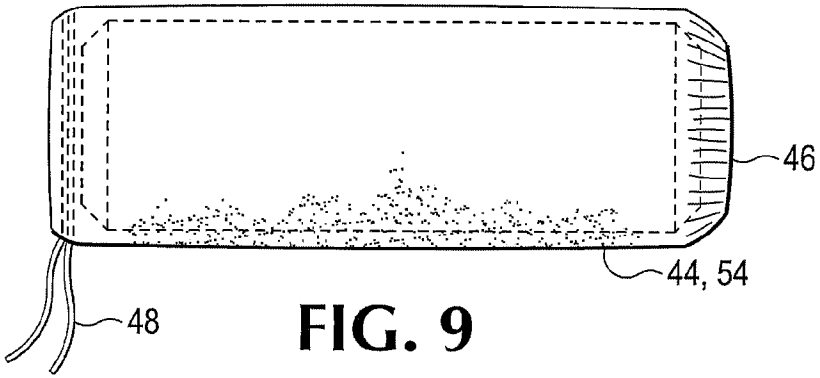
FIG. 9 is a side elevational view of a fabric cover such as one of those shown in FIG. 8, for the core of a bore-cleaning body of the device.

The core 32 is somewhat resiliently flexible, such that it may be compressed along its length, causing it to expand radially in size with a poisson effect to accommodate somewhat varied bore sizes as well as provide different radial pressures, as desired, against the interior surfaces of a bore being cleaned. The textile type of the tubular cover 44 may be varied in thread size or coarseness and substrate material to achieve different cleaning actions. The fabric cover 44 may be constructed with an elastic member 46 or a drawstring 48 in a hem at each end as shown in FIG. 9, to insure the tubular cover 44 stays in place on the core 32 and does not roll onto itself as the cleaning device 20 is pulled through a bore during the cleaning action. The end portions of the cover 44 are captured between the thick rubber or similar material of the similar opposite end plates 42 and 50 and the ends of the core 32 utilizing a mechanical compression action created when the core is compressed by tightening the front end cap 38 along the threaded rod 22 toward a rear end lock nut 56. The leading or front cleaning body 28 of the cleaning device 26 may also be of a selected length, such as in a range of 8 inches to 10 inches for a 105 millimeter cannon bore, to have more or less outer surface area as specifically needed for the cleaning application. The end plate 50 can act as a buffer between the front bore-cleaning body 28 or oiling zone and the brushes 36.

Following the leading bore-cleaning body section 28 is a scrubbing section including multiple radially extending stiff yet flexible slender or wire-like members with exposed ends, generally in the form of the radial brushes 36, to scrape away residue, as shown also in FIG. 9. The radially extending members of the brushes 36 can be of varying materials such as but not limited to brass, steel and stainless steel wire to act as bristles of a brush in a scrubbing mechanism that follows the geometric contour of the interior features of the barrel being cleaned. A brush with Nylon or other resin fibers could be used on HC Chromium coated barrels. The main purpose of the brushes is to mechanically loosen adhered build-up of material such as gun powder residue and wadding. This generally cylindrical or wheel-shaped scrubbing device or brush zone 36 can be of a selected axial dimension along the length of the bore-cleaning device 20 as dictated by the cleaning application. A spacer 52 of a selected thickness 53 may be located between two brushes 36. This spacer 52 acts as a residue trap to contain carbon fouling and any residue that has been dislodged. The thickness 53 of this spacer 52 can be larger for particularly fouled applications. The brushes 36 can be quickly removed and replaced on the rod 22, and field tests have shown that the brushes 36 did an excellent job of cleaning the propellant and projectile residue from both the chamber and the bore of a 105 millimeter tank cannon.

Next is the rear bore-cleaning body 30 of the bore cleaner 20. This rear bore-cleaning body 30 of the bore-cleaning device 20 is similar in many ways to the front or oiling body 28. The body 30 may also have a core 34 core similar to the core 32, made of a rubber center with a thin outer layer of a soft foam rubber, also able to be compressed longitudinally along the rod 22 to cause outward radial expansion. Because it is intended to absorb and wipe away solvents and loosened residue and leave the bore clean, the rear bore-cleaning body 30 is desirably longer than the front bore-cleaning body 28. A strong and abrasive fabric sock or cover 54 that may desirably be absorbent is provided. For example a loop pile fabric of Nylon or other synthetic fiber with pile loops around 0.1 inch in height and spacing seems to perform well for the cover 54. Such a material is readily available and used for heavy duty headliners in motor vehicles. This fabric does a excellent cleaning job because of its rough surface character, ability to trap particles, and absorbency to soak up excess solvents and oil. This cover 54 also can be quickly removed by just loosening the top cap 38 and the bottom lock nut 56, then sliding the sock or cover 54 over and off the trailing or breech end 26 of the cleaning device 20. A new cover 54 can be slipped into place between end plates 55 and 58 without removing any parts. This fabric cover 54 does not need to be treated with any oil before use of the bore-cleaning device 20. Its purpose is to swab out all the residue loosened by the oiling swab or front bore-cleaning body 28 and broken loose by the brushes 36. When bore-cleaning device 20 was run through a rusted 105 millimeter cannon barrel it was clearly seen how well it worked because all the rust was on the front end of the fabric sock or cover 54 and none halfway back.

Figure 3A:
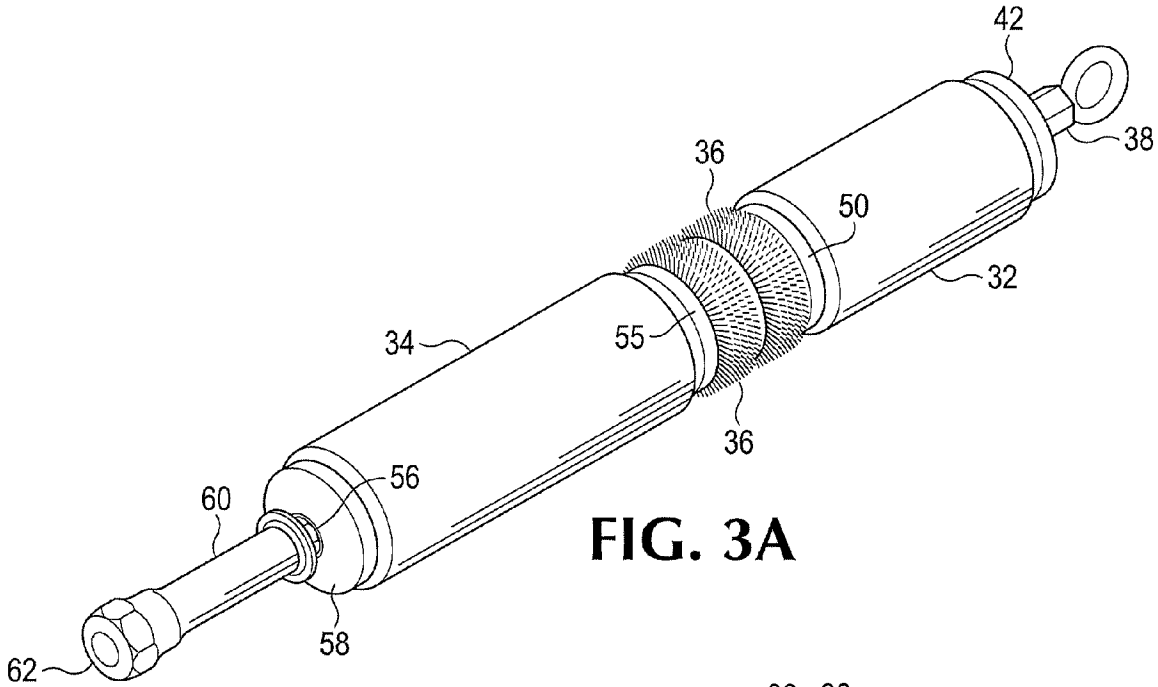
FIG. 3A is an isometric view taken from a breech end of the device shown in FIGS. 1 and 2.
Figure 3B:
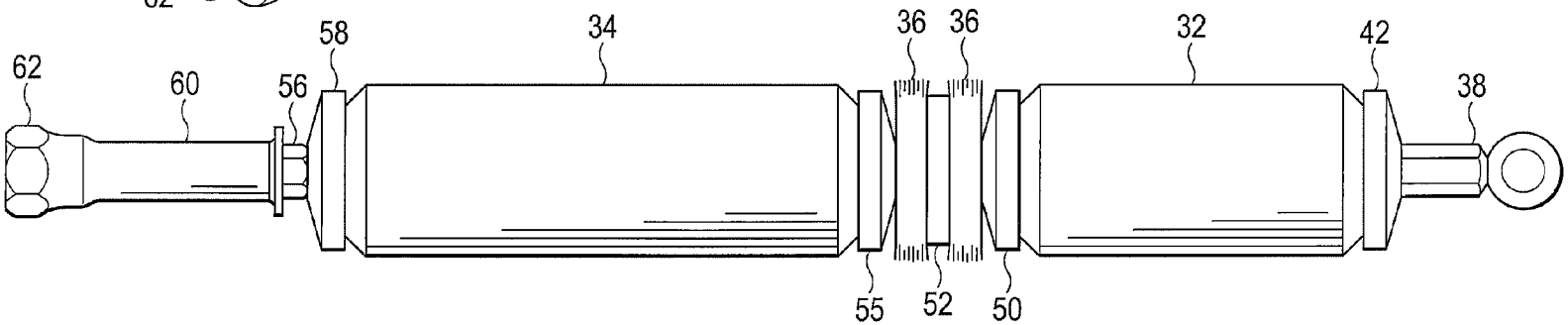
FIG. 3B is a side elevational view of the body of the bore-cleaning device shown in FIG. 3A but without the fabric covers for the cores.
Figure 4:
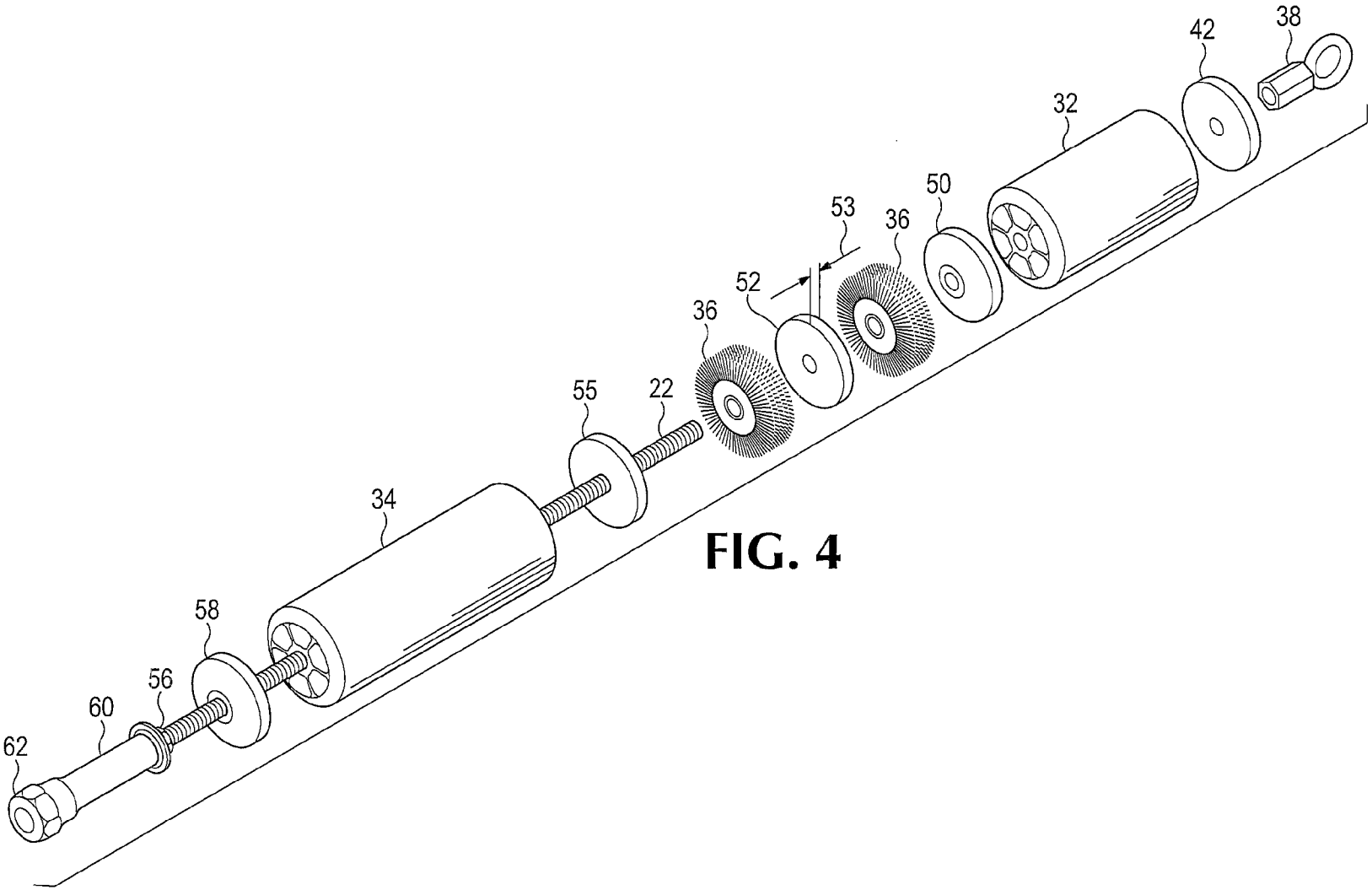
FIG. 4 is an exploded view of the bore-cleaning device shown in FIG. 3A.
Figure 5A:
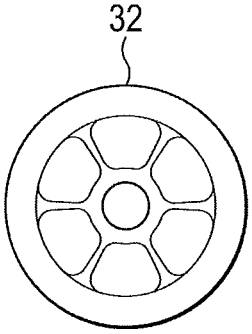
FIGS. 5A, 5B and 5C are views from different angles showing the core of one portion of the bore-cleaning device shown in FIGS. 1-4.
Figure 5B:
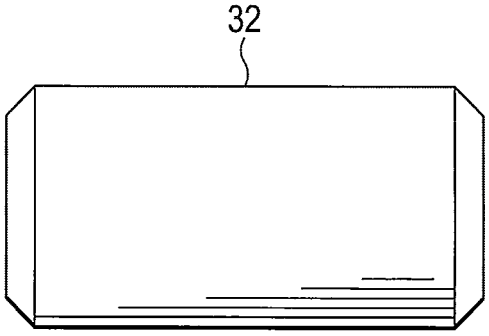
Figure 5C:
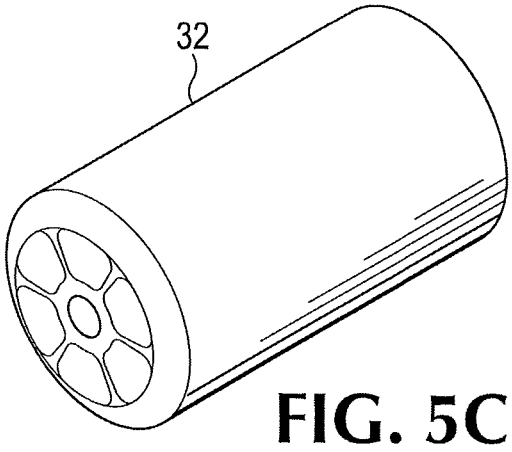

The bore-cleaning device 20 is kept together on the central rod 22 by the locking nut system, as seen in FIGS. 1, 3B and 4. While the end cap 38 is attached to the rod 22 at the leading, or muzzle end 24, the lock nut 56 secures the rubber end member 58 against the bottom of the rear core 34, which also secures the fabric cover 54. A pipe 60, which may be about 6 inches in length, is welded to the lock nut 56, and provides a convenient and quickly useful longitudinal compression and radial expansion handle, for loosening and or tightening tension in the rod 22. It also is very convenient for carrying the bore cleaner 20 in and out of a gun being cleaned. A 1¼-inch end nut 62 with a 1-inch female thread may be welded to the rear end of the pipe 60. The purpose of this nut 62 is that it can receive and mate with a conventional push rod used for cleaning devices for large-bore military guns, so that the bore cleaner 20 can be pushed through the bore if desired, as well as being pulled by the cable 40.

The core-compression internal tensioning member of the cleaning head 20, described above as the rod 22, may vary in material makeup due to the application. In large bore cleaning applications, the threaded member will typically be a rigid device such as the all thread, stainless steel rod 22 or some other rigid material. While a rod 22 may be simplest, for the largest bores multiple parallel rods (not shown) or another lighter weight construction may be desired. In small bore cleaning applications, the compression or internally tensioning member may be constructed from a strong flexible material such as small-diameter flexible wire cable, or polytetrafluoroethylene (Teflon), to provide an amount of flexibility needed over the length of the bore cleaning head. This is particularly desired where there may be a need to curve the cleaning head to introduce it into the breech of a repeating firearm being serviced. Such a cable or Teflon member may have threaded metal fittings at each end to facilitate fastening the small-bore cleaning head to the appropriate tension-bearing member 40 in the form of a flexible cord or cable, and to apply necessary compression to a core of, for example, rubber tubing fitted over the cable or Teflon member, as will be described below with reference to FIGS. 10-12.

The cleaning system described herein provides flexibility to the armorer or technician who is cleaning a gun barrel. It dramatically reduces the cycle time of cleaning a bore of a gun barrel, particularly an artillery piece, by incorporating multiple functions into one action, thus providing cost savings to the unit or person tasked with the cleaning the bore of a firearm completely enough to permit reliable inspection. It can also dramatically reduce the residual propellant or projectile particles left in the interior of gun-equipped vehicles such as tanks, due to the fact that the cleaning process starts at the breech of the barrel and finishes at the muzzle, moving residue out of the bore at the muzzle.

Figure 6:
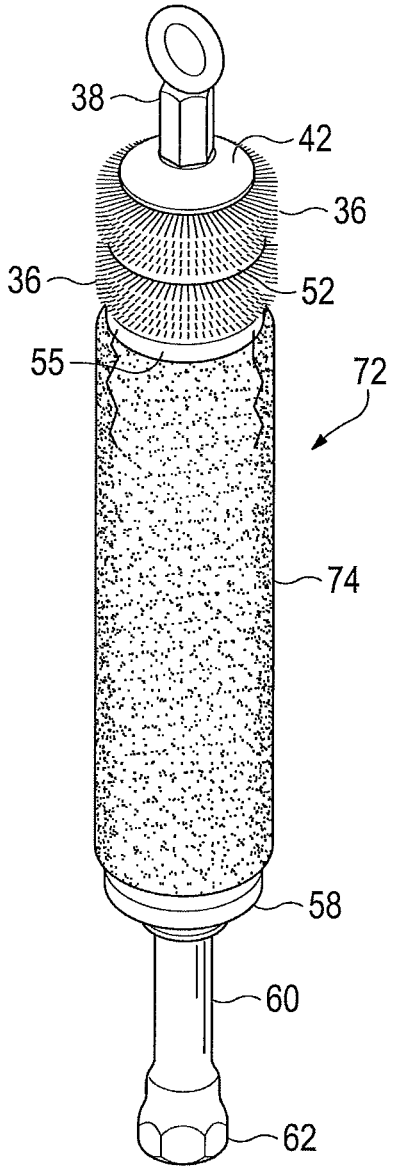
FIG. 6 is an isometric view of another embodiment of the bore-cleaning device.

In FIG. 6 a bore cleaner 72 is shown in which there is no front bore-cleaning body 28, but only the scrubbing brushes 36 and rear bore-cleaning body portion 30 with a fabric cover 74 that may be similar to the cover 54 described above. The bore cleaner 72 may be used in a gun bore where it is not desired to use oil or solvent ahead of the main mechanical scrubbing action.

Figure 7:
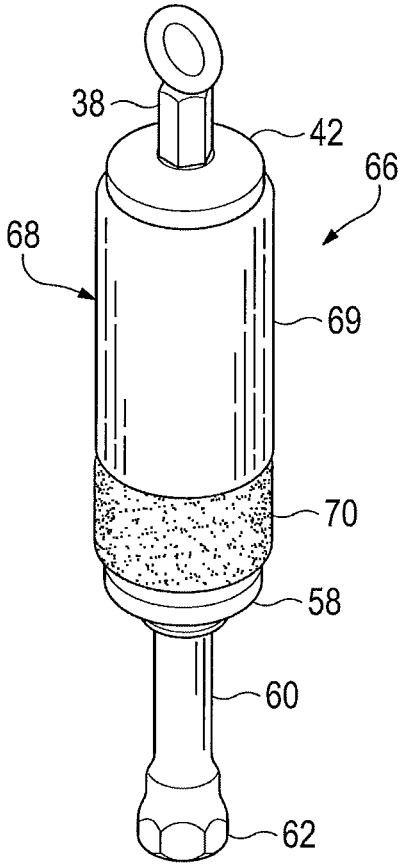
FIG. 7 is an isometric view of yet another embodiment of the bore-cleaning device described herein.

FIG. 7 shows another short version 66 of the bore cleaner. Its purpose is for a quick clean, or for use in Chromium barrels, or to oil a barrel when there is a need to put oil in the bore for storage or transport. Its smaller size is advantageous for it to be carried in a tank where space is important, for cleaning a gun barrel. The cover 68 of this short version of the bore cleaner may include two portions of different qualities of fabric, a front part 69 being more absorbent, to carry a quantity of lubricating oil and solvent, and the other, rear, portion 70, being of coarser, more abrasive material to complete the cleaning action as the bore cleaner 66 is moved through the bore being cleaned.

Figure 8:
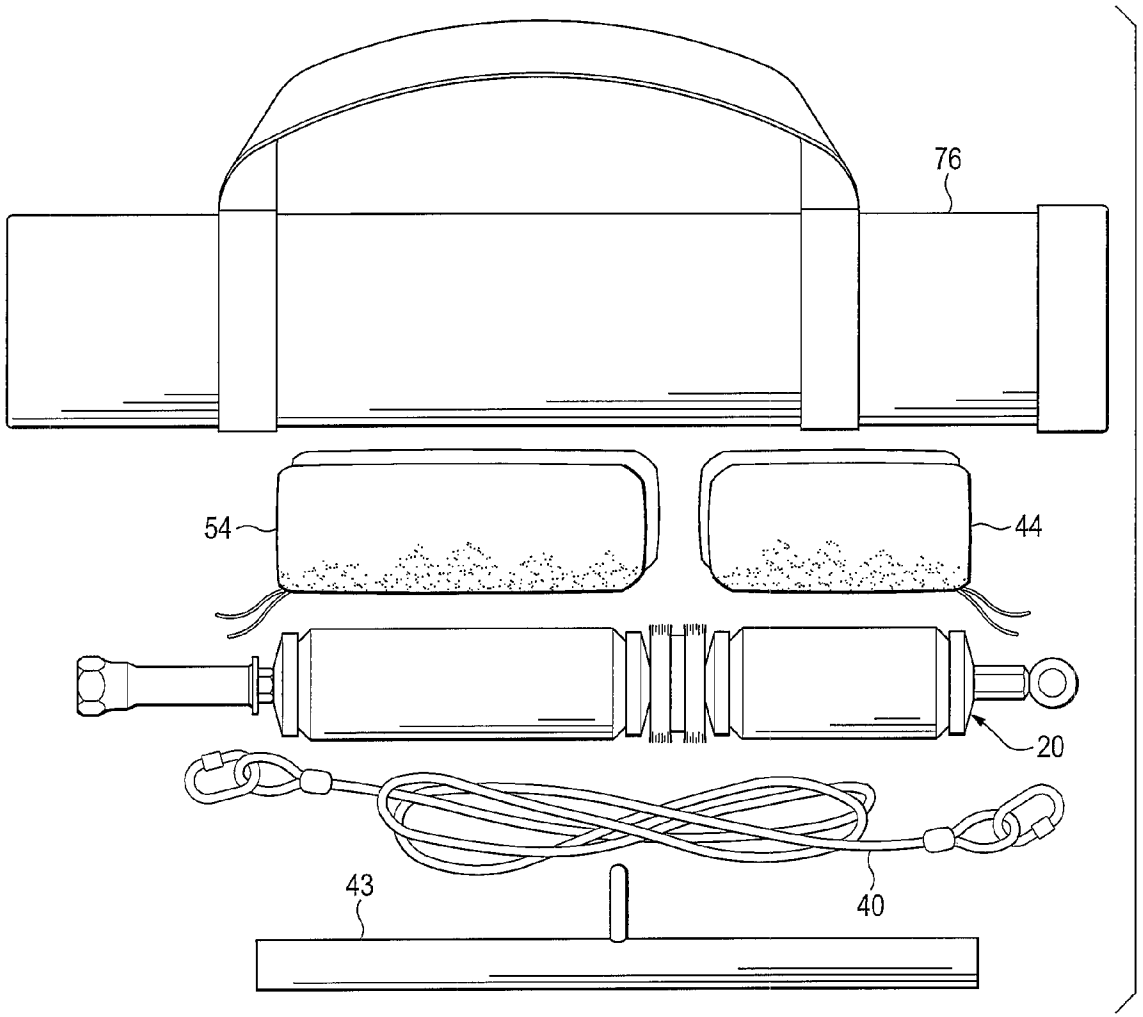
FIG. 8 is a side elevational view of the bore-cleaning device shown in FIGS. 1 and 2, together with a carrying case, spare covers for the cores of the bore-cleaning bodies of the device, a tension bearing cable, and a handle for pulling the device through a bore being cleaned.

As shown in FIG. 8 a carrying case 76 made from hard plastic plumbing pipe may be used to hold the bore cleaner 20 or 66 or 72 and its accessories, including a pull handle 78 that may be made from pipe.

Figure 10:
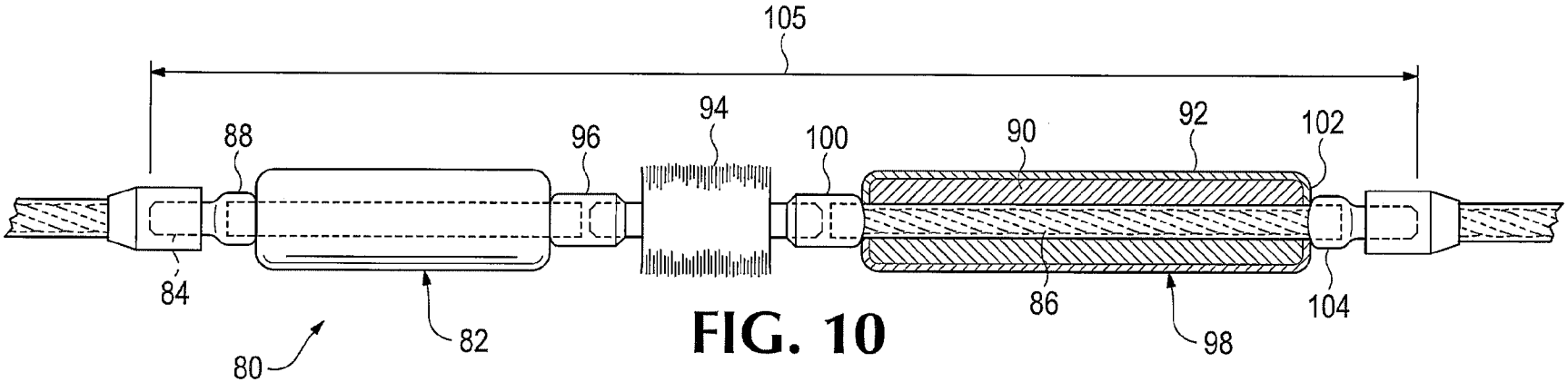
FIG. 10 is a partially cutaway side elevational view of a bore-cleaning device adapted for a small-bore firearm.

Referring next to FIG. 10, a bore-cleaning device 80 more particularly intended for use with small bore firearms such as rifles with a bore caliber of, for example 0.30 inch or 0.22 inch, may need to be flexible in order to negotiate and be drawn into the breech of a barrel through a portion of a loading mechanism, as in a pump, or slide action gun, a lever action rifle, or a semi-automatic rifle.

The bore-cleaning device 80 includes a leading bore-cleaning body 82. A short threaded rod 84 is connected to a leading end of an internal tension-bearing member 86 of the leading bore-cleaning body 82 that for example may be a plastic-coated flexible cable by a swaged, crimped, brazed, or other connection at 88. A core of an elastomeric material such as a length of rubber tubing 90 is fitted snugly around the cable 86, and a tubular fabric cover 92 of material such as knitted small diameter elastic surgical bandage material is fitted over the rubber tubing, with the ends of the cover 92 extending over the ends of the rubber tubing 90. Such tubular bandage material is available readily from medical supply companies. The ends of the covers 92 may be held by elastic pressure between the tubing 90 and the connectors 88 and 96, which thus act as end members of the bore-cleaning bodies 82 and 98. A scrubber section such as a short wire brush 94 with radially extending bristles is connected to the rear, or trailing, end of the cable core of the leading body section 82 by a swaged or crimped connector 96. The bristles, or scraping members, of the brush 94 should extend radially to at least the radius of the covers 92 on the rubber tubing 90. A leading end of a tension-bearing member 86 of plastic coated cable of a trailing body section 98 is attached to the trailing end of the wire brush portion 94 by a similar swaged or crimped connector 100. The rear or trailing body tension-bearing member of plastic-coated cable 86 is covered similarly by a length of rubber tubing 90 and a tubular fabric cover 92, which may similarly be held. At the trailing end 102 of the plastic-coated cable 86 of the rear or trailing body section 98 another threaded fitting is attached also by a swaged or crimped connector 104. The resulting bore-cleaning device 80 may thus have a total length 105 of as much as about three inches or as little as about 1⅝ inches. The flexible nature makes it practical to use the bore-cleaning device 80 in even the smallest, such as .22 caliber, repeating firearms.

Figure 11:
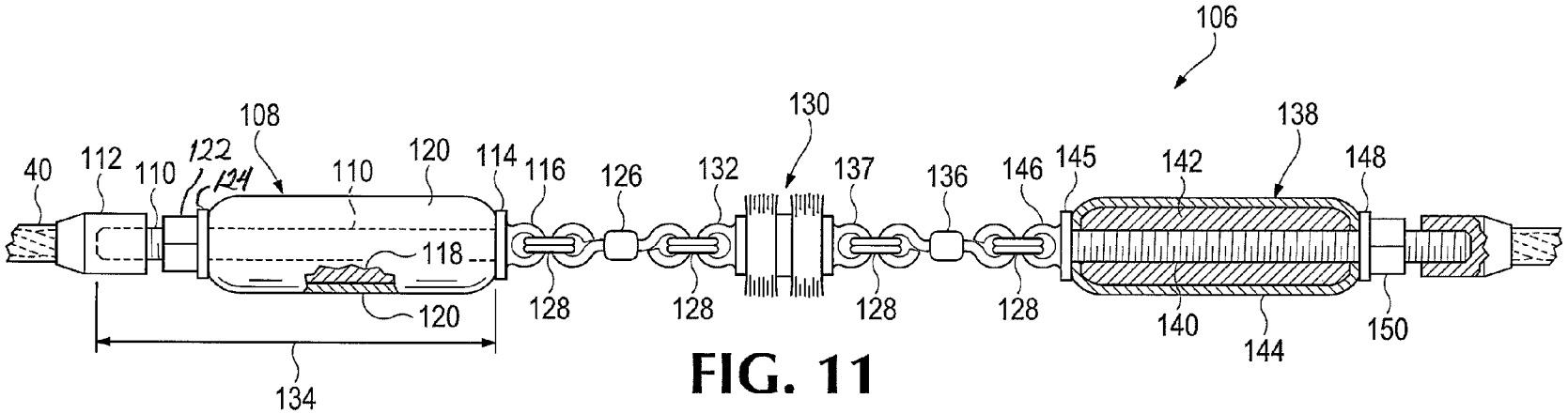
FIG. 11 is a partially cutaway side elevational view of another bore-cleaning device adapted for a small-bore firearm.
Figure 12:
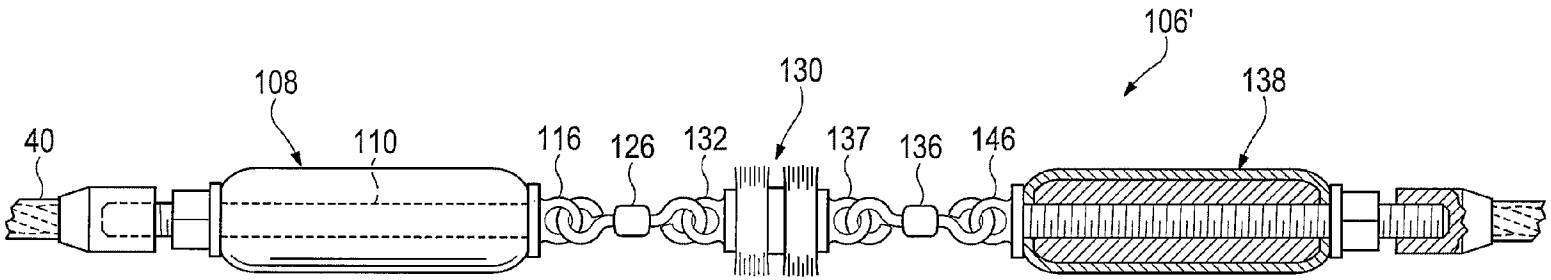
FIG. 12 is partially cutaway view of a bore-cleaning device that is a variation of the device shown in FIG. 11.

FIGS. 11 and 12 show similar bore-cleaners 106 and 106' that are further variations of the bore-cleaner adapted for cleaning small-bore firearms. A leading body section 108 of each may include a core 110 of a small-diameter threaded metal rod such as a 10-32 fine threaded rod, with a female threaded fitting 112 of a tension-bearing flexible member, or cable, 40 threaded onto the leading end of the rod 110. A flange 114 and an eye 116 are mounted on the rear end of the rod 110, and a length of tubing 118 of a resilient and flexible, rubberlike material is fitted over the rod 110 and abutted against the flange 114. The tubing 118 may, for example, be a length of rubber tubing having an outside diameter slightly less than that of the bore to be cleaned. A small tubular cover or sock 120 of absorbent fabric is fitted over the tubing 118. A compatible nut 122 is also threaded onto the rod 110, holding a washer 124 against the leading end of the tubing 118 and the cover 120. At the trailing end of the rod 110 the tubing 118 and the cover 120 are held against the flanges 114 by tightening the nut 122 toward the flange 114, with sufficient tension in the rod 110 to expand the tubing 118 radially to a diameter required to support the cover 120 against the interior of a bore to be cleaned. A swivel 126 may be attached to the eye 116 by a splitring 128 with an opposite end of the swivel 126 being attached to a small wheel-like wire brush portion 130 which may be similar to a pair of small Dremel™ tool brushes, by another splitring 128 linking the eye of the swivel with an eye 132 at the leading end of the brush section.

The threaded rod 110 of the leading body section 108 may have a relatively short length 134, such as being in the range of ¼ inch-¾ inch, and having a length 134 of about ⅜ inch in one embodiment, in order to be maneuvered through the available space in the loading port of a repeating firearm while remaining attached to the brush portion 130.

Another swivel 136 is attached to the rear end of the brush 130 and to the leading end of a trailing body section 138 that may be of similar construction to the leading body section 108, including a small threaded rod 140, a length of rubber tubing 142 and a fabric cover 144. A leading end of the rod 140 has a flange 145 and an eye 146, and another splitring 128 connects the swivel 136 to the eye 146. A washer 148 and a nut 150 are fitted on the rod at the rear end of the tubing 142. The nut 150 may be used to compress the rubber tubing 142 along the rod 140 and thereby cause the diameter of the rubber tubing to expand in order to provide a desired amount of radially outward pressure from the rubber tubing to press the fabric tube cover 144 outward against the surfaces of the interior of the bore to be cleaned. Another cable 152 may be fastened to the trailing end of the rod by a female threaded fitting connected to the end of the core rod 140.

The bore-cleaning device 106', shown in FIG. 12, is similar except that the splitrings 128 are omitted, and wire eyes at the ends of each swivel 126 and 136 are linked directly with the eyes 116, 132, 137, and 146 on the threaded rods 110 and 140 and on the wire brush portion 130.

To utilize the bore-cleaning device 20, first slide the coated tension-bearing cable 40 down the barrel to be cleaned, from the muzzle and bring the loop out from the chamber or breech. Then hook the cable 40 to the front ring or eye on the top cap 38, using a shackle or carabiner. At this time apply oil and solvent to the cover 44 of the leading bore-cleaning body 28, and insert the cleaner 20 into the chamber. At the muzzle of the barrel use the pull handle to pull the cleaner 20 through the barrel. There should be tight resistance, to indicate that it is working correctly. Too light resistance means that the end cap 38 and nut 56 are not well enough tightened, and the bore cleaner is not expanded and getting into the grooves. The bore cleaner can be removed easily from the muzzle. The covers 44 and 54 can be inspected to see if the bore cleaner 20 removed the fouling.

Because of the cleaning head stack design, the reusable nature of the compression cores and the replaceable tubular covers 44 and 54 and scrubbing brushes 36 as described below, the system lends itself to be used multiple times. "Service Kits" of varying types can be provided. The Service Kits may consist of one tubular cover for each of the cleaning zones of the system, and two scrubbing devices. These kits may be made available to the market with multiple options for the materials of the tubular covers 44 and 54 offering the user different fabric coarseness as for specific applications. The scrubbing devices, or brushes 36 offered in the service kits may be offered with options such as wire type, wire count variations, and wire coating variations for example. In addition, there may be other options, including cleaning agent kits, and spacers 52 of varying thicknesses 53 for applications that require larger or smaller residue traps between the scrubbing devices 36.

Use of the small bore-cleaning devices 80, 106, and 106' is basically similar except for size of the devices.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A bore-cleaning device comprising:

(a) an elongate bore-cleaning body having a leading first end and including a generally cylindrical core having a pair of opposite ends;

(b) an internal tensioning member extending longitudinally through said generally cylindrical core of said bore-cleaning body;

(c) a pair of end members, each of said end members being outwardly adjacent a respective one of the opposite ends of the core and interconnected with the internal tensioning member so as to be capable of applying a selected amount of pressure longitudinally to the generally cylindrical core, so as to compress the core in a longitudinal direction and thereby cause the core to expand radially;

(d) a cover of flexible material surrounding the core and having an outer wiping surface; and (e) a connector interconnected with the bore-cleaning body at said first end thereof and arranged to receive a tension-bearing member useful for pulling said bore-cleaning device through a bore.

2. The bore-cleaning device of claim 1 including a pair of said bore-cleaning bodies interconnected with each other in tandem so as to be pulled simultaneously and moved together through a bore.

3. The bore-cleaning device of claim 2 wherein each of said bore-cleaning bodies includes a core and an internal tensioning member extending longitudinally through the core so as to compress the respective core longitudinally and cause the respective core to expand radially.

4. The bore-cleaning device of claim 2 wherein a first one of said pair of bore-cleaning bodies is softer than a second one and includes a layer of resilient absorbent material surrounding the core thereof.

5. The bore-cleaning device of claim 2 including a scrubber section including an array of radially-extending slender, flexible, scraping members fastened between the ones of said pair of bore-cleaning bodies, the scraping members extending radially at least to a radius of one of said bore-cleaning bodies.

6. The bore-cleaning device of claim 5 wherein a single, continuous internal tensioning member extends through both of said pair of bore-cleaning bodies and said scrubber section.

7. The device of claim 5 wherein said array is a circular brush.

8. The device of claim 5 including a pair of said arrays located between the ones of said pair of bore-cleaning bodies, the ones of said pair of arrays being separated from each other by a distance in a longitudinal direction with respect to said bore-cleaning device.

9. The bore-cleaning device of claim 1 wherein said outer wiping surface of said cover is of a loop-pile fabric.

10. The bore-cleaning device of claim 1 wherein said cover is tubular and has a length greater than said length of said core and has an end portion extending radially inward adjacent said end of said core and held between said end of said core and a respective one of said pair of end members.

11. The bore-cleaning device of claim 1 wherein each of said end members conforms generally to a respective one of the opposite ends of said core.

12. A bore-cleaning device comprising:

(a) an elongate bore-cleaning body having a leading first end and including a generally cylindrical core having a pair of opposite ends;

(b) an internal tensioning member extending longitudinally through said generally cylindrical core of said bore-cleaning body;

(c) a pair of end members, each of said end members being outwardly adjacent a respective one of the opposite ends of the core and interconnected with the internal tensioning member so as to be capable of applying a selected amount of pressure longitudinally to the generally cylindrical core, so as to compress the core in a longitudinal direction and thereby cause the core to expand radially;

(d) a cover of flexible material surrounding the core and having an outer wiping surface; and (e) a connector interconnected with the bore-cleaning body at said first end thereof and arranged to receive a tension-bearing member useful for pulling said bore-cleaning device through a bore.

13. A bore-cleaning device comprising:

(a) an elongate bore-cleaning body having a leading first end and including a generally cylindrical core of an elastomeric material having a pair of opposite ends;

(b) a flexible internal tension bearing member extending longitudinally through said generally cylindrical core of said bore-cleaning body;

(c) a pair of end members, each of said end members being outwardly adjacent a respective one of the opposite ends of the core and interconnected with the internal tension bearing member so as to apply pressure longitudinally to the generally cylindrical core and thereby to compress the core in a longitudinal direction;

(d) a cover of flexible material surrounding the core and having an outer wiping surface; and (e) a connector interconnected with the bore-cleaning body at said first end thereof and arranged to receive a tension-bearing member useful for pulling said bore-cleaning device through a bore.

14. The bore-cleaning device of claim 13, wherein a portion of said cover is held between an end of the core and an adjacent one of said pair of end members.

15. The bore-cleaning device of claim 13 including a pair of said bore-cleaning bodies interconnected with each other in tandem so as to be pulled simultaneously and moved together through a bore.

16. A bore-cleaning device comprising:

(a) a pair of elongate bore-cleaning bodies, each one of said pair having:

(i) a leading first end and a generally cylindrical core of an elastomeric material having a pair of opposite ends;

(ii) a flexible internal tension bearing member extending longitudinally through said generally cylindrical core of said bore-cleaning body;

(iii) a pair of end members, each of said end members being outwardly adjacent a respective one of the opposite ends of the core and interconnected with the internal tension bearing member so as to apply pressure longitudinally to the generally cylindrical core and thereby to compress the core in a longitudinal direction;

(iv) a cover of flexible material surrounding the core and having an outer wiping surface; and (v) a connector interconnected with the bore-cleaning body at said first end thereof and arranged to receive a tension-bearing member useful for pulling said bore-cleaning device through a bore; and (b) said pair of bore-cleaning bodies being interconnected with each other in tandem so as to be pulled simultaneously and moved together through a bore; and (c) said bore-cleaning device including a scrubber section including an array of radially-extending slender, flexible, scraping members fastened between the ones of said pair of bore-cleaning bodies, the scraping members extending radially at least to a radius of one of said bore-cleaning bodies.

* * * * *